US006165259A

United States Patent [19]

Hällström et al.

[11] Patent Number: 6,165,259

[45] Date of Patent: Dec. 26, 2000

[54] AQUEOUS DISPERSIONS OF HYDROPHOBIC MATERIAL

[75] Inventors: Hans Hällström, Nacka; Sten Frölich, Askim; Erik Lindgren, Bohus; Rein Sikkar, Floda, all of Sweden

[73] Assignee: Akzo Nobel N.V., Arnhem, Netherlands

[21] Appl. No.: 09/017,905

[22] Filed: Feb. 3, 1998

Related U.S. Application Data

[60] Provisional application No. 60/038,431, Feb. 19, 1997.

[30] Foreign Application Priority Data

| | | | |
|---|---|---|---|
| Feb. 5, 1997 | [EP] | European Pat. Off. | 97850016 |
| Feb. 5, 1997 | [EP] | European Pat. Off. | 97850017 |
| Dec. 30, 1997 | [SE] | Sweden | 9704932 |

[51] Int. Cl.[7] ..... B01F 3/12; C09D 201/08; D21H 17/14; D21H 17/17

[52] U.S. Cl. ..... 106/243; 106/287.24; 162/158; 162/164.6; 162/177; 516/58; 516/77

[58] Field of Search ..... 516/58, 77; 106/243, 106/287.24; 162/158, 179, 164.6, 177

[56] References Cited

U.S. PATENT DOCUMENTS

| | | | |
|---|---|---|---|
| 2,926,117 | 2/1960 | Wittcoff | 162/164.6 |
| 2,986,488 | 5/1961 | Weisgerber et al. | 162/158 |
| 3,046,186 | 7/1962 | Arlt | 162/167 |
| 3,311,532 | 3/1967 | Kulick et al. | 106/243 |
| 3,409,500 | 11/1968 | Strazdins et al. | 162/164.6 X |
| 3,887,427 | 6/1975 | Helmer et al. | 162/158 |
| 4,096,127 | 6/1978 | Schurmann et al. | 162/164.6 X |
| 4,240,935 | 12/1980 | Dumas . | |
| 4,522,686 | 6/1985 | Dumas | 162/158 |
| 4,529,447 | 7/1985 | Okada et al. | 106/287.24 |
| 4,670,100 | 6/1987 | Henning et al. | 162/164.6 X |
| 4,687,519 | 8/1987 | Trzasko et al. | 106/211 |
| 4,743,303 | 5/1988 | Helmer et al. | 106/236 |
| 4,784,727 | 11/1988 | Schröer et al. | 106/243 X |
| 4,816,073 | 3/1989 | Helmer et al. | 106/238 |
| 5,192,363 | 3/1993 | Bussell et al. | 106/218 |
| 5,308,393 | 5/1994 | Hättich et al. | 106/243 X |

FOREIGN PATENT DOCUMENTS

| | | | |
|---|---|---|---|
| 0 220 941 | 5/1987 | European Pat. Off. | D21H 3/02 |
| 0 418 015 | 3/1991 | European Pat. Off. | D21H 17/17 |
| 1 551 645 | 8/1979 | United Kingdom | C08L 93/00 |
| WO 86/02677 | 5/1986 | WIPO | D21H 3/34 |
| WO 94/24169 | 10/1994 | WIPO | C08B 11/15 |
| WO 96/17127 | 6/1996 | WIPO | D21H 17/74 |

*Primary Examiner*—Richard D. Lovering
*Attorney, Agent, or Firm*—Ralph J. Mancini; Lainie E. Parker

[57] ABSTRACT

The invention relates to an aqueous dispersion containing a dispersant and a disperse phase containing a hydrophobic material, the dispersant comprising an anionic compound having a molecular weight less than 50,000 and being selected from the group consisting of carbon-containing compounds and silicon-containing compounds, and a cationic organic compound having a molecular weight less than 50,000. The invention further relates to the preparation and use of the dispersion in the production of paper. The invention also relates to a substantially water-free composition containing a hydrophobic material, an anionic compound having a molecular weight less than 50,000 and being selected from carbon-containing compounds and silicon-containing compounds, and a cationic organic compound having a molecular weight less than 50,000, as well as it use in the preparation of an aqueous dispersion.

24 Claims, No Drawings

AQUEOUS DISPERSIONS OF HYDROPHOBIC MATERIAL

This application claims the benefit of Provisional Application Ser. No. 60/038,431, filed on Feb. 19, 1997.

The present invention relates to aqueous dispersions of hydrophobic material and more specifically to dispersions having a dispersant system containing two oppositely charged compounds, their preparation and use.

BACKGROUND

Aqueous dispersions of hydrophobic material are well-known and used in numerous applications. For instance, in papermaking, aqueous dispersions of hydrophobic material are used as sizing agents in order to give paper and paper board some degree of resistance to wetting and penetration by aqueous liquids. Examples of hydrophobic materials widely used for sizing include cellulose-reactive sizing agents, e.g. alkyl ketene dimers and substituted succinic anhydrides, and non-cellulose-reactive sizing agents, e.g. rosin-based and resin-based sizing agents.

Dispersions of hydrophobic material generally contain an aqueous phase and finely divided particles or droplets of the hydrophobic material dispersed therein. The dispersions are usually prepared by homogenizing the hydrophobic, water insoluble material in an aqueous phase in the presence of a dispersant using high shear forces and fairly high temperatures. Dispersants conventionally used include anionic, amphoteric and cationic high molecular weight polymers, e.g. rignosulfonates, starches, polyamines, polyamideamines, and vinyl addition polymers. The polymers can be used singly, together or in combination with other compounds to form a dispersant system. Depending on the overall charge of the components of the dispersant system, the size dispersions will be anionic or cationic in nature.

Dispersions of hydrophobic material usually exhibit rather poor stability and high viscosity, even at relatively low solids contents, which evidently lead to difficulties in handling the dispersions, for example on storage and in use. A further drawback is that the products have to be supplied as low concentration dispersions which further increases the costs of transportation of the active hydrophobic material.

It is accordingly an object of this invention to provide aqueous dispersions of hydrophobic material with improved stability and viscosity properties. It is another object of this invention to provide improved aqueous dispersions of sizing agent, notably cellulose-reactive sizing agents. Further objects will appear hereinafter.

THE INVENTION

In accordance with the present invention it has been found that improved stability and viscosity properties can be obtained with aqueous dispersions of hydrophobic material in which the hydrophobic material is dispersed in the aqueous phase by means of a dispersant comprising two oppositely charged compounds having relatively low molecular weights. More specifically, the invention relates to an aqueous dispersion containing a disperse phase comprising a hydrophobic material and a dispersant comprising an anionic compound having a molecular weight less than 50,000 and being selected from organic compounds and silicon-containing compounds, and a cationic organic compound having a molecular weight less than 50,000. The invention thus relates to an aqueous dispersion, its preparation and use, as further defined in the claims.

The present invention makes it possible to provide dispersions of hydrophobic material with improved storage stability, higher solids content and/or lower viscosity. In addition, when using the dispersions in applications involving very high dilution of the initially high concentration dispersion, it has been found that the disperse phase is more stable, i.e. the dispersions exhibit improved dilute stability. Examples of applications with extremely high dilution include papermaking wet-end conditions and stock or internal sizing which involves addition of a dispersion of hydrophobic material to an aqueous suspension containing cellulosic fibers and optional filler. In this context, improved dilute stability means less aggregation of the particles or droplets of hydrophobic sizing agent, thereby forming lower levels of bigger aggregates with lower sizing efficiency, as well as less deposition of the hydrophobic sizing agent on the paper machine and less wire contamination, thereby reducing the need for maintenance of the paper machine. Further benefits observed with the present dispersions include improved stability in the presence of disturbing substances, e.g. anionic trash derived from impure pulps and/or recycled fibers, and less accumulation of the hydrophobic material in white water recirculating in the papermaking process. Accordingly, dispersions of this invention are particularly useful in processes where white water is extensively recirculated and where the cellulosic suspension contains a substantial amount of trash. Furthermore, the dispersions of this invention also makes it possible to obtain improved sizing over conventional size dispersions at a corresponding dosage of sizing agent and to use a lower dosage of sizing agent to attain a corresponding level of sizing. The possibility of using lower amounts of sizing agent to attain in-specification sizing further reduces the risk of accumulation of non-adsorbed hydrophobic sizing agents in the white water recirculating in the process, thereby further reducing the risk of aggregation and deposition of the hydrophobic material on the paper machine. The present invention thus offers substantial economic and technical benefits.

The hydrophobic material present in the dispersion preferably is substantially insoluble in water. Examples of suitable hydrophobic materials include compounds useful as sizing agents in papermaking which can be derived from both natural and synthetic sources, e.g. cellutose-reactive hydrophobes and non-cellulose-reactive hydrophobes. In a preferred embodiment, the hydrophobic material has a melting point below about 100° C. and notably below about 75° C.

In a preferred embodiment of this invention, the hydrophobic material is a cellulose-reactive sizing agent which can be selected from any of the cellulose-reactive sizing agents known in the art. Suitably the sizing agent is selected from the group consisting of hydrophobic ketene dimers, ketene multimers, acid anhydrides, organic isocyanates, carbamoyl chlorides and mixtures thereof, preferably ketene dimers and acid anhydrides, most preferably ketene dimers. Suitable ketene dimers have the general formula (I) below, wherein $R^1$ and $R^2$ represent saturated or unsaturated hydrocarbon groups, usually saturated hydrocarbons, the hydrocarbon groups suitably having from 8 to 36 carbon atoms, usually being straight or branched chain alkyl groups having 12 to 20 carbon atoms, such as hexadecyl and octadecyl groups. Suitable acid anhydrides can be characterized by the general formula (II) below, wherein $R^3$ and $R^4$ can be identical or different and represent saturated or unsaturated hydrocarbon groups suitably containing from 8 to 30 carbon atoms, or $R^3$ and $R^4$ together with the —C—O—C moiety can form a 5 to 6 membered ring, optionally being further substituted with hydrocarbon groups /containing up to 30 carbon atoms. Examples of acid anhydrides which are used commercially include alkyl and alkenyl succinic anhydrides and particularly isooctadecenyl succinic anhydride.

(I)

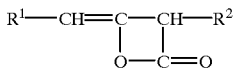

(II)

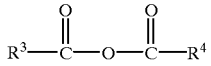

Suitable ketene dimers, acid anhydrides and organic isocyanates include the compounds disclosed in U.S. Pat. No. 4,522,686, which is hereby incorporated herein by reference. Examples of suitable carbamoyl chlorides include those disclosed in U.S. Pat. No. 3,887,427 which is also incorporated herein by reference.

In another preferred embodiment of this invention, the hydrophobic material is a non-cellulose-reactive hydrophobe which can be selected from any of the non-cellulose-reactive sizing agents known in the art. Suitably the non-cellulose-reactive sizing agent is selected from the group consisting of hydrophobes based on rosin, e.g. rosin, disproportionated rosin, hydrogenated rosin, polymerized rosin, formaldehyde-treated rosin, esterified rosin, fortified rosin and mixtures of such treatments and so treated rosins, fatty acids and derivatives thereof, e.g. fatty acid esters and amides like bis-stearamide, resin and derivatives thereof, e.g. hydrocarbon resins, resin acids, resin acid esters and amides, waxes, e.g. crude and refined paraffin waxes, synthetic waxes, naturally occurring waxes, etc.

Dispersions according to this invention contain a dispersant, or dispersant system, comprising at least one anionic compound and at least one cationic compound, both having a low molecular weight (hereinafter LMVV). The LMW compounds are preferably bound together by the force of electrostatic attraction, thereby representing a coacervate dispersant. When used in combination, the LMW compounds are effective as a dispersant for the hydrophobic material, although the anionic and cationic compounds do not have to be, and usually are not, effective as a dispersant when used singly. In a preferred embodiment, at least one of the anionic and cationic compounds is a polyelecrolyte. The term "polyelectrolyte", as used herein, refers to a compound having two or more charged (anionic/cationic) groups and charged (anionic(cationic) compounds acting as a polyelectrolyte, e.g. through chemical non-ionic interaction or attraction.

The anionic compound of the dispersant contains one or more anionic groups of the same or different types and include anionic compounds having one anionic group and anionic compounds having two or more anionic groups, herein referred to as an anionic polyelectrolyte. Anionic polyelectrolytes may contain one or more cationic groups as long as it has an overall anionic charge. Examples of suitable anionic groups include sulfate groups and carboxylic, sulfonic, phosphoric and phosphonic acid groups which may be present as free acid or as water-soluble ammonium or alkali metal (generally sodium) salts, e.g. sodium carboxylates and sulfonates. Anionic polyelectrolytes can have a degree of substitution varying over a wide range; the degree of anionic substitution ($DS_A$) can be from 0.01 to 1.4, suitably from 0.1 to 1.2 and preferably from 0.2 to 1.0.

The anionic compound of the dispersant can be derived from synthetic and natural sources and preferably it is water-soluble or water-dispersable. In a preferred embodiment, the anionic compound is an organic compound, i.e. containing carbon atoms. Suitable anionic compounds include anionic surfactants like alkyl, aryl and alkylaryl sulfates and ethersulfates, alkyl, aryl and alkylaryl carboxylates, alkyl, aryl and alkylaryl sulfonates, alkyl, aryl and alkylaryl phosphates and etherphosphates, and dialkyl sulfosuccinates, the alkyl groups having from 1 to 18 carbon atoms, the aryl groups having from 6 to 12 carbon atoms, and the alkylaryl groups having from 7 to 30 carbon atoms. Examples of suitable anionic surfactants include sodium lauryl sulfate, sodium lauryl sulfonate and sodium dodecylbenzenesulfonate. Further examples of suitable anionic compounds include anionic polyelectrolytes such as anionic organic LMW polymers, optionally degraded, e.g. those derived from phosphated, sulphonated and carboxylated polysaccharides like starches, guar gums and celluloses, preferably cellulose derivatives and notably carboxymethyl celluloses, as well as condensation products, e.g. anionic polyurethanes and condensated naphthalene sulfonates, and further vinyl addition polymers formed from monomers with anionic groups, e.g. acrylic acid, methacylic acid, maleic acid, itaconic acid, crotonic acid, vinylsulfonic acid, sulfonated styrene and phosphates of hydroxyalkyl acrylates and methacrylates, optionally copolymerized with non-ionic monomers including acrylamide, alkyl acrylates, styrene and acrylonitrile as well as derivatives of such monomers, vinyl esters, and the like. The anionic compound can also be selected from LMW inorganic compounds containing silicon atoms such as, for example, silicates and various forms of condensated or polymerized silicic acid, e.g. oligomeric silicic acid, polysilicic acids, polysilicates, polyaluminiumsilicates, polysilicate microgels, polyaluminiumsilicate microgels and silica-based material, e.g. in the form of silica sols, which have negative hydroxyl groups.

The cationic compound of the dispersant contains one or more cationic groups of the same or different types and include cationic compounds having one cationic group and cationic compounds having two or more cationic groups, herein referred to as a cationic polyelectrolyte. Cationic polyelectrolytes may contain one or more anionic groups as long as it has an overall cationic charge. Examples of suitable cationic groups include sulfonium groups, phosphonium groups, acid addition salts of primary, secondary and tertary amines or amino groups and quaternary ammonium groups, for example where the nitrogen has been quaternized with methyl chloride, dimethyl sulfate or benzyl chloride, preferably acid addition salts of amines/amino groups and quaternary ammonium groups. Cationic polyelectrolytes can have a degree of substitution varying over a wide range; the degree of cationic substitution ($DS_c$) can be from 0.01 to 1.0, suitably from 0.1 to 0.8 and preferably from 0.2 to 0.6.

The cationic compound of the dispersant can be derived from synthetic and natural sources and preferably it is water-soluble or water-dispersable. The cationic compound preferably is an organic compound. Examples of suitable cationic compounds include cationic surfactants, e.g. compounds of the type $R_4N^+X^-$, wherein each R group is independently selected from (i) hydrogen; (ii) hydrocarbon groups, suitably aliphatic and preferably alkyl groups, having from 1 to about 30 carbon atoms, preferably from 1 to 22 carbon atoms; and (iii) hydrocarbon groups, suitably aliphatic and preferably alkyl groups, having up to about 30 carbon atoms, preferably from 4 to 22 carbon atoms, and being interrupted by one or more heteroatoms, e.g. oxygen or nitrogen, and/or groups containing a heteroatom, e.g. carbonyl and acyloxy groups; where at least one, suitably at least three and preferably all of said R groups contain carbon atoms; suitably at least one and preferably at least two of said R groups containing at least 7 carbon atoms, preferably at least 9 carbon atoms and most preferably at least 12 carbon atoms; and wherein X— is an anion, typically a halide like chloride, or an anionic group present in the anionic compound of the dispersant, e.g. where the surfactant is a protonated amine of the formula $R_3N$ wherein R and N are as defined above. Examples of suitable surfactants include dioctyldimethylammonium chloride, didecyldimethylammonium chloride, dicocodimethylammonium chloride, cocobenzyldimethylammonium chloride, coco (fractionated)benzyldimethylammonium chloride, octadecyl trimethylammonium chloride, dioctadecyl dimethylammonium chloride, dihexadecyl dimethylammonium chloride, di(hydrogenated tallow)dimethylammonium chloride, di(hydrogenated tallow)benzylmethylammonium chloride, (hydrogenated tallow)benzyldimethylammonium chloride, dioleyldimethylammonium chloride, and di(ethylene hexadecanecarboxylate)dimethylammonium chloride. Particularly preferred cationic surfactants thus include those containing at least one hydrocarbon group with from 9 to 30 carbon atoms and notably quaternary ammonium compounds. Further suitable cationic surfactants include quaternary di- and polyammonium compounds containing at least one hydrocarbon group, suitably aliphatic and preferably alkyl, with from 9 to 30 carbon atoms, preferably from 12 to 22 carbon atoms. Examples of suitable surfactants of this type include N-octadecyl-N-dimethyl-N'-trimethylpropylene-diammonium dichloride. Further examples of suitable cationic compounds include cationic polyelectrolytes such as cationic organic LMW polymers, optionally degraded, e.g. those derived from polysaccharides like starches and guar gums, cationic condensation products like polyurethanes, polyamideamines, e.g. polyamideamine-epichlorohydrins, polyamines, e.g. dimethylamine-epichlorohydrin copolymers, dimethylamine-ethylenendiamine-epichlorohydrin-copolymers, ammonia-ethylene dichloride copolymers, vinyl addition polymers formed from monomers with cationic groups, e.g. homopolymers and copolymers of diallyldimethylammonium chloride, dialklaminoalkyl acrylates, methacrylates and acrylamides (e.g. dimethylaminoethyl acrylates and methacrylates) which usually are present as acid addition salts or quaternary ammonium salts, optionally copolymerized with non-ionic monomers including acrylamide, alkyl acrylates, styrene and acrylonitrile and derivatives of such monomers, vinyl esters, and the like.

Both the anionic LMW compound and the cationic LMW compound for use in this invention have a molecular weight (hereinafter MW) less than 50,000, suitably less than 30,000 and preferably less than 20,000. Further benefits can be seen where the MW of the anionic compound and/or the cationic compound of the dispersant is even lower, for example less than 15,000 and notably less than 10,000. Normally the anionic and cationic compounds have an MW above 200 and suitably above 500. Usually the anionic and cationic surfactants have a lower MW than the anionic and cationic polyelectrolytes; preferred surfactants have an MW from 200 to 800. When one of the compounds of the dispersant is a surfactant, another compound of the dispersant should preferably be a polyelectrolyte, which may have an MW as defined above.

Preferred dispersions of this invention contain a dispersant selected from the group consisting of a dispersant (i) comprising a cationic surfactant and an anionic polyelectrolyte where the dispersant has an overall anionic charge; a dispersant (ii) comprising a cationic polyelectrolyte and an anionic polyelectrolyte where the dispersant has an overall anionic charge; a dispersant (iii) comprising an anionic surfactant and a cationic polyelectrolyte where the dispersant has an overall cationic charge; and a dispersant (iv) comprising an anionic polyelectrolyte and a cationic polyelectrolyte where the dispersant has an overall cationic charge; the anionic and cationic surfactants, the anionic and cationic polyelectrolytes and their molecular weights being as defined above.

The anionic and cationic compounds of the dispersant can be present in the dispersion in amounts varying within wide limits depending on, inter alia, the molecular weight of the compounds, the degree of ionic substitution of the compounds, i.e. the charge density, the desired overall charge of the dispersion and the hydrophobic material used. Both the anionic compound and the cationic compound can be present in an amount of up to 100% by weight, suitably from 0.1 to 20% by weight and preferably from 1 to 10% by weight, based on the hydrophobic material.

It has been found that the dispersions according to the invention can be prepared in high solids contents and yet exhibit very good stability on storage and low viscosity. This invention provides dispersions of hydrophobic material with improved storage stability and/or high solids content. Partcularly preferred dispersions in this regard include dispersions of cellulose-reactive sizing agent, notably dispersions having a dispersant with an overall anionic charge. Dispersions of cellulose-reactive sizing agents according to the invention generally can have sizing agent contents of from about 0.1 to about 50% by weight, suitably above 20% by weight. Dispersions containing a ketene dimer sizing agent according to the invention may have ketene dimer contents within the range of from 5 to 50% by weight and preferably from about 10 to about 35% by weight. Dispersions, or emulsions, containing an acid anhydride sizing agent according to the invention may have acid anhydride contents within the range of from about 0.1 to about 30% by weight and usually from about 1 to about 20% by weight. Dispersions of non-cellulose-reactive sizing agents generally can have sizing agent contents of from 5 to 50% by weight and preferably from 10 to 35% by weight.

The dispersions according to the invention can be produced by mixing an aqueous phase with the dispersant system and the hydrophobic material, preferably at a temperature where the hydrophobic material is liquid, and homogenizing the mixture so obtained, suitably under pressure. The obtained aqueous emulsion, which contains droplets of the hydrophobe, normally having a size of from 0.1 to 3.5 $\mu$m in diameter, is then cooled. In addition to the above-mentioned components other materials can also be incorporated into the size dispersions, such as, for example, additional dispersants and stabilizers, e.g. non-ionic dispersants, extenders, e.g. urea and urea derivatives, and preservative agents. It will be appreciated that the negative and positive charges of the compounds of the dispersant can be formed in situ, for example by contacting the compounds with one another and/or by mixing the compounds with an aqueous phase and/or by lowering pH of the aqueous phase. For instance, the loss of a hydrogen from an acid group will form an anionic charge, and a basic amine or an amino group can be rendered cationic by protonation or abstraction of a hydrogen. Accordingly, it is possible to start with uncharged compounds in preparing the dispersion. For example, an organic compound with basic amino groups or a basic amine of the formula $R_3N$ can be used, where the corresponding ammonium moiety $R_4N^+ X^-$ be formed in the preparation process, where R, N and X can be as defined above.

It has been found that the components of the present dispersions can be easily homogenized in the presence of an aqueous phase, in particular where the LMW compounds of the dispersant are used in combination with hydrophobic materials having a melting point below about 100° C. and notably below about 75° C. Usually less energy and lower shear forces are required in this process compared to processes for preparing conventional dispersions and hereby simplified equipment can be employed. Therefore, a further method of preparing the dispersions comprises (i) mixing the hydrophobic material with the anionic and cationic compounds of the dispersant to obtain an intermediate composition, and (ii) homogenizing the intermediate composition in the presence of an aqueous phase, as described above. It is preferred that the components are homogeneously mixed in stage (i). The hydrophobe used in stage (i) may be solid although it is preferred that it is liquid in order to simplify homogeneous mixing. If desired, the intermediate composition can be removed after the mixing stage (i), and optionally be cooled for solidification, to form a substantially water-free intermediate composition containing the dispersant and the hydrophobic material which enables simplified shipping in an economically attractive manner. At the location of intended use, or elsewhere, the intermediate hydrophobe composition can be homogenized in the presence of water in conventional or simplified manner, optionally at elevated temperature so as to render the intermediate composition liquid. This method is especially attractive when preparing dispersions of ketene dimers and acid anhydrides, the latter of which usually being prepared in the paper mill in direct connection to its use as a sizing agent in the production of paper. The provision of a storage stable substantially water-free composition thus offers considerable economic and technical benefits. The present invention thus also relates to a substantially water-free concentrate composition comprising a hydrophobic material, an anionic LMW compound selected from carbon-containing compounds and silicon-containing compounds, and a cationic organic LMW compound, where the anionic and cationic compounds when used in combination are effective as a dispersant system for the hydrophobic material in an aqueous phase, its preparation and use, as further defined in the claims.

The components that are present in the concentrate composition according to the invention, i.e., the hydrophobic material and the anionic and cationic compounds, preferably are as defined above. The composition is substantially water-free and hereby is meant that a small amount of water can be present; the water content can be from 0 up to 10% by weight, suitably less than 5% by weight and preferably less than 2%. Most preferably it contains no water. The composition preferably contains the hydrophobic material in a predominant amount, based on weight, i.e. at least 50% by weight, and suitably the composition has a hydrophobe content within the range of from 80 to 99.9% by weight and preferably from 90 to 99.7% by weight The anionic and cationic compounds can be present in the composition in amounts defined above with respect to the dispersions where the percentages are based on hydrophobic material. Accordingly, both the anionic compound and the cationic compound can be present in the composition in an amount of up to 100% by weight, suitably from 0.1 to 20% by weight and preferably from 1 to 10% by weight, based on the hydrophobic material.

The dispersions of this invention can be used as sizing agents in conventional manner in the production of paper using any type of cellulosic fibers and it can be used both for surface sizing and internal or stock sizing. The term "paper", as used herein, is meant to include not only paper but all types of cellulose-based products in sheet and web form, including, for example, board and paperboard. The stock contains cellulosic fibers, optionally in combination with mineral fillers, and usually the content of cellulosic fibers is at least 50% by weight, based on dry stock. Examples of mineral fillers of conventional types include kaolin, china clay, titanium dioxide, gypsum, talc and natural and synthetic calcium carbonates such as chalk, ground marble and precipitated calcium carbonate. The amount of hydrophobic sizing agent added to the stock can be from 0.01 to 5% by weight suitably from 0.05 to 1.0% by weight, based on the dry weight of cellulosic fibers and optional fillers, where the dosage is mainly dependent on the quality of the pulp or paper to be sized, the sizing agent used and the level of sizing desired.

In a preferred embodiment, the dispersions are used in stock sizing of cellulosic pulp where the stock has a high cationic demand and/or contains substantial amounts of lipophilic substances, e.g. stocks prepared from certain grades of wood-containing and recycled pulps, for example where recirculation of white water is extensive. Particularly preferred dispersions in such uses include dispersions of cellulose-reactive sizing agent and dispersions having a dispersant with an overall anionic charge. Usually the cationic demand is at least 50, suitably at least 100 and preferably at least 150 $\mu$eq/liter stock filtrate. The cationic demand can be measured in conventional manner, for example by means of a Mütek Particle Charge Detector using a stock filtrate obtained from a raw stock filtered through a 1.6 $\mu$m filter and poly(diallyldimethylammonium chloride) as a titrant. The amount of lipophilic extractives may be at least 10 ppm, usually at least 20 ppm, suitably at least 30 ppm and preferably at least 50 ppm, measured as ppm DCM by means of extraction using DCM (dichloromethane) in known manner. Further, the present dispersions are preferably used in papermaking processes where white water is extensively recirculated, i.e. with a high degree of white water closure, for example where from 0 to 30 tons of fresh water are used per ton of dry paper produced, usually less than 20, suitably less than 15, preferably less than 10 and notably less than 5 tons of fresh water per ton of paper. Recirculation of white water in the process preferably takes place by mixing the white water with cellulosic fibers, preferably in the form of a stock or suspension, before or after the addition of the sizing dispersion, e.g. to form the stock to be dewatered. Fresh water can be introduced in the process at any stage; for example, it can be mixed with cellulosic fibers in order to form the stock, and it can be mixed with a stock containing cellulosic fibers to dilute it so as to form the stock to be dewatered, before or after mixing the stock with white water and before or after the addition of the sizing dispersion.

Chemicals conventionally added to the stock in papermaking such as retention aids, aluminium compounds, dyes, wet-strength resins, optical brightening agents, etc., can of course be used in conjunction with the present sizing dispersions. Non-cellulose-reactive sizing agents are usually used with an aluminium compound for fixing the sizing agent to the cellulosic fiber. Examples of aluminium compounds include alum, aluminates and polyaluminium compounds, e.g. polyaluminium chlorides and sulphates. Examples of suitable retention aids include cationic polymers, anionic inorganic materials in combination with organic polymers, e.g. bentonite in combination with cationic polymers, silica-based sols in combination with cationic polymers or cationic and anionic polymers. Particularly good stock sizing can be obtained when using the dispersions of the invention in combination with retention aids comprising cationic polymers. Suitable cationic polymers include cationic starch, guar gum, acrylate and acrylamide-based polymers, polyethyleneimine, dicyandiamide-formaldehyde, polyamines, polyamidoamines and poly(diallyidimethyl ammoniumchloride) and combinations thereof. Cationic starch and cationic acrylamide-based polymers are preferably used, either alone or in combination with each other or with other materials. In a preferred embodiment of the invention, the dispersions are used in combination with a retention system comprising at least one cationic polymer and anionic silica-based particles. The present dispersions can be added. Before, between, after or simultaneously with the addition of the cationic polymer or polymers. It is also possible to premix the size dispersion with a retention aid, e.g. a cationic polymer like catonic starch or a cationic acrylamide-based polymer, or an anionic silica-based material, prior to introducing the mixture thus obtained into the stock. Accordingly, the dispersion can be prepared just prior to introducing it into the stock by bringing into contact a size dispersion containing the cationic compound, preferably a cationic surfactant, with an anionic silica-based material, for example as defined above.

The invention is further illustrated in the following examples, which, however, are not intended to limit the same. Parts and % relate to parts by weight and % by weight, respectively, unless otherwise stated.

EXAMPLE 1

A dispersion of hydrophobic alkyl ketene dimer (AKD) according to the invention was prepared by mixing di(hydrogenated tallow)dimethylammonium chloride, which is a cationic surfactant with an MW of 340, commercially available under the trade name Querton 442, Akzo Nobel, with molten AKD at 70° C., passing the mixture through a homogenizer in the presence of an aqueous solution of a condensated sodium naphthalene-sulphonate with an estimated MW of about 6,000, commercially availably under the trade name Orotan™ SN, Rohm & Haas Company, and then cooling the dispersion so obtained. The pH of the dispersion was adjusted to about 5 by addition of acid. The dispersion, denoted Dispersion No. 1, had an AKD content of 30% and contained 6% of the anionic compound and 4% of the cationic compound, both based on the weight of AKD. The dispersions contained particles of the cellulose-reactive hydrophobe with an average particle size of about 1 $\mu$m which were anionically charged, as shown by a negative zeta potential determined by means of a Zeta-Master S Version PCS.

EXAMPLE 2

Stability of the dispersion of Example 1 was tested as follows: The dispersion was diluted with water to give a dispersion containing 40 ppm of AKD. In some of the tests 10 ppm of stearic acid was added in order to evaluate the stability in the presence of a liphophilic, anionic trash substance. The dilute dispersion was placed in a jar equipped with a device for turbidity measurements, a loop, circulation means and heating and cooling means. A set volume of the dilute dispersion was circulated in the loop while automatically recording the turbidity and subjecting the dispersion to a heating and cooling cycle for a set time period of 45 minutes. The temperature of the dispersion was raised from 20° C. to 62° C. and then lowered again to 20° C. Turbidity is affected by particle size and the difference in turbidity of the dispersion before and after a temperature cycle is a measure of the ability of the dispersed particles to withstand growth by agglomeration and thus a measure of the stability of the dispersion. The difference in turbidity ($\Delta T$) is calculated as follows: $\Delta T$=(final turbidity/initial turbidity)×100. The higher the $\Delta T$ the better the stability.

Two standard dispersions were also tested for comparison purposes, Ref. 1 is an anionic AKD dispersion containing a dispersant system consisting of sodium lignosulphonate and a high molecular weight (HMW) cationic starch where the anionic lignosulphonate is present in ionic excess; Ref. 2 is a cationic AKD dispersion also containing sodium lignosulphonate and HMW cationic starch but where the cationic starch is present in ionic excess. Table 1 gives the results obtained.

TABLE 1

| Dispersion No. | Stearic acid [ppm] | $\Delta T$ |
|---|---|---|
| 1 | — | 72 |
| 1 | 10 | 55 |
| Ref. 1 | — | 45 |
| Ref. 1 | 10 | 32 |
| Ref. 2 | — | 35 |
| Ref. 2 | 10 | 6 |

As is shown in Table 1 the $\Delta T$ values of the dispersion of this invention were considerably higher than-those of the standard dispersions which accordingly are indicative of better dilute stability.

EXAMPLE 3

A water-free concentrate composition according to the invention was prepared by dry mixing 93 parts of AKD pellets with 3 parts of the cationic surfactant and 4 parts of the anionic compound used in Example 1. This dry mixture was later added to hot water and the aqueous mixture so obtained was heated to 80° C., pumped through a high shear pump and then cooled to room temperature. The resulting anionic dispersion, Dispersion No. 2, had an AKD content of 20% and an average particle size of about 1 $\mu$m.

Sizing efficiency was evaluated by preparing paper sheets according to the standard method SCAN-C23X for laboratory scale, and using a papermaking stock containing 80% of 60:40 bleached birch/pine sulphate and 20% of chalk to which 0.3 g/l of $Na_2SO_4 10H_2O$ had been added. Stock consistency was 0.5% and pH 8.0. The dispersions were used in conjunction with a commercial retention and dewatering system. Compozil™, comprising cationic starch and an anionic aluminium-modified silica sol which were added to the stock separately; the cationic starch was added in an amount of 12 kg/ton, based on dry stock, and the silica sol was added in an amount of 0.8 kg/ton, calculated as $SiO_2$ and based on dry stock Cobb values, measured according to TAPPI standard T 441 OS-63, obtained in the tests are set forth in Table 2. The dosage of AKD is based on dry stock.

TABLE 2

| Dispersion No. | AKD dosage [kg/ton] | Cobb 60 [g/m$^2$] |
|---|---|---|
| 2 | 0.30 | 58 |
| 2 | 0.40 | 30 |
| Ref. 1 | 0.30 | 84 |
| Ref. 1 | 0.40 | 65 |
| Ref. 2 | 0.30 | 66 |
| Ref. 2 | 0.40 | 40 |

Table 2 demonstrates the improvement in paper sizing obtained with the dispersion according to the invention.

EXAMPLE 4

Ease of manufacture of dispersions according to the invention was evaluated by preparing anionic AKD dispersions at different AKD contents. Dispersions of the invention were prepared by homogenising a mixture of 0.8% by weight of di(hydrogenated tallow)dimethylammonium chloride, 1.6% by weight of condensated sodium naphthalene-sulphonate, 77.6% by weight of water and 20% by weight of AKD for a set time using an Ultra Turrax mixer at 15.000 rpm and then cooling the dispersion so obtained for 2 hours. Similar dispersions were prepared in the same manner at different AKD contents in order to provide dispersions with AKD contents of 10, 20, 30 and 40% by weight. The dispersions are denoted Inv. followed by the AKD content in % by weight.

Standard AKD dispersions were manufactured for comparison purposes in the same manner and under the same conditions by homogenising a mixture of 1.0% by weight of cationic starch, 0.25% by weight of sodium lignosulfonate, 89% by weight of water and 10% by weight of AKD. Similar dispersions were prepared at different AKD contents in order to provide standard dispersions with AKD contents of 10, 20, 30 and 40% by weight. The dispersions are denoted Ref. 3 followed by the AKD content in % by weight.

Particle size and viscosity were assessed in conventional manner. Table 3 shows the results obtained.

TABLE 3

| AKD Dispersion No. | Particle size ($\mu$m) | Viscosity (cps) |
|---|---|---|
| Inv. - 10% | 2.98 | 10 |
| Inv. - 20% | 3.12 | 20 |
| Inv. - 30% | 3.50 | 20 |
| Inv. - 40% | 3.50 | 25 |
| Ref. 3 - 10% | 4.31 | 15 |
| Ref. 3 - 20% | 4.52 | 20 |
| Ref. 3 - 30% | 5.20 | 25 |
| Ref. 3 - 40% | 5.57 | 40 |

Table 3 demonstrates that the dispersions according to the invention were easier to to manufacture; a lower viscosity was obtained at corresponding AKD contents and a smaller particle size was obtained using the same amount of energy to set surfaces free. Compared to the standard dispersion, less energy and lower shear forces are thus required according to this invention in order to manufacture dispersions with equal particle size. In addition, an increase in stirrer speed to 25,000 rpm considerably reduced the particle size of the dispersions according to the invention to be within the range of from 1 to 2 $\mu$m.

We claim:

1. Aqueous dispersion containing an anionic dispersant and a disperse phase containing a hydrophobic sizing agent wherein the dispersant comprises (a) an anionic polyelectrolyte having a molecular weight of less than 50,000 selected from the group consisting of carbon-containing compounds, silicon-containing compounds and mixtures thereof, and (b) a cationic organic polyelectrolyte or cationic organic surfactant having a molecular weight of less than 50,000.

2. The dispersion of claim 1, wherein the anionic polyelectrolyte and the cationic organic polyelectrolyte or cationic organic surfactant have a molecular weight less than 20,000.

3. The dispersion of claim 1, wherein the anionic polyelectrolyte is organic.

4. The dispersion of claim 1, wherein (b) is a cationic organic surfactant.

5. The dispersion of claim 1, wherein (b) is a cationic organic polyelectrolyte.

6. The dispersion of claim 5 wherein said cationic and anionic polyelectrolytes each have a molecular weight of less than 10,000.

7. Aqueous dispersion containing a cationic dispersant and a disperse phase containing a hydrophobic sizing agent wherein the cationic dispersant comprises (a) an anionic surfactant or anionic polyelectrolyte having a molecular weight of less than 50,000 selected from the group consisting of carbon-containing compounds, silicon-containing compounds and mixtures thereof, and (b) a cationic organic polyelectrolyte having a molecular weight of less than 50,000.

8. The dispersion of claim 7, wherein said cationic organic polyelectrolyte has a molecular weight of less than 10,000.

9. The dispersion of claim 7, wherein (a) is an anionic polyelectrolyte, and said anionic polyelectrolyte and cationic organic polyelectrolyte each have a molecular weight of less than 10,000.

10. The dispersion of claim 1, wherein the content of hydrophobic sizing agent is at least 20% by weight.

11. The dispersion of claim 1, wherein the hydrophobic sizing agent is a cellulose-reactive sizing agent.

12. The dispersion of claim 11, wherein the sizing agent is a ketene dimer or an acid anhydride.

13. The dispersion of claim 1, wherein the hydrophobic sizing agent has a melting point below 75° C.

14. The dispersion of claim 1, wherein the anionic polyelectrolyte has a molecular weight of less than 10,000.

15. A method for the preparation of an aqueous dispersion by homogenizing a hydrophobic sizing agent in the presence of an aqueous phase and an anionic dispersant comprising an anionic polyelectrolyte having a molecular weight of less than 50,000 selected from the group consisting of carbon-containing compounds, silicon-containing compounds and mixtures thereof, and a cationic organic polyelectrolyte or cationic organic surfactant having a molecular weight of less than 50,000.

16. The method of claim 15, wherein the anionic polyelectrolyte and the cationic organic polyelectrolyte or cationic organic surfactant have a molecular weight less than 20,000, and the anionic polyelectroylte is organic.

17. The method of claim 15, which further comprises a step of providing a substantially water-free composition containing the hydrophobic sizing agent and the anionic dispersant prior to the step of homogenizing the hydrophobic sizing agent and the anionic dispersant in the presence of the aqueous phase.

18. The method of claim 15, wherein said cationic organic polyelectrolyte or cationic organic surfactant has a molecular weight of less than 10,000.

19. Substantially water-free sizing composition comprising a hydrophobic sizing agent, and an anionic composition containing an anionic polyelectrolyte having a molecular weight of less than 60,000 selected from the group consisting of carbon-containing compounds, silicon-containing compounds, and mixtures thereof and a cationic organic polyelectrolyte or cationic organic surfactant having a molecular weight of less than 50,000.

20. The composition of claim 19, wherein the anionic polyelectrolyte and the cationic organic polyelectrolyte or cationic organic surfactant have a molecular weight less than 20,000, and the anionic polyelectrolyte is organic.

21. The composition of claim 20, wherein the hydrophobic sizing agent is a ketene dimer or an acid anhydride.

22. The composition of claim 19, wherein said cationic organic polyelectrolyte or cationic organic surfactant has a molecular weight of less than 10,000.

23. An aqueous dispersion containing an anionic dispersant and a disperse phase containing a hydrophobic ketene dimer sizing agent, wherein the anionic dispersant comprises (a) an anionic organic polyelectrolyte having a molecular weight of less than about 20,000 and (b) a cationic surfactant having a molecular weight of from about 200 to about 800.

24. The dispersion of claim 23 wherein the cationic surfactant has the formula:

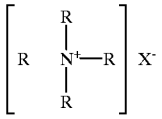

wherein each R group is independently selected from the group consisting of (a) hydrocarbon groups having from 1 to about 30 carbon atoms; and (b) hydrocarbon groups having up to about 30 carbon atoms and being interrupted by one or more heteroatoms and/or groups containing a heteroatom; wherein at least two of said R groups contain at least 9 carbon atoms; and wherein X is an anion.

* * * * *

UNITED STATES PATENT AND TRADEMARK OFFICE

CERTIFICATE OF CORRECTION

PATENT NO. : 6,165,259
DATED : December 26, 2000
INVENTOR(S) : Hallstrom, Hans et al.

It is certified that error appears in the above-identified patent and that said Letters Patent is hereby corrected as shown below:

Column 14,
Line 20, change the "X" to -- $X^-$ --

Signed and Sealed this

Second Day of April, 2002

*Attest:*

*Attesting Officer*

JAMES E. ROGAN
*Director of the United States Patent and Trademark Office*